US008475228B2

(12) United States Patent
Benvegnu et al.

(10) Patent No.: US 8,475,228 B2
(45) Date of Patent: Jul. 2, 2013

(54) POLISHING PAD WITH PARTIALLY RECESSED WINDOW

(75) Inventors: Dominic J. Benvegnu, La Honda, CA (US); Boguslaw A. Swedek, Cupertino, CA (US); Jimin Zhang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 13/106,635

(22) Filed: May 12, 2011

(65) Prior Publication Data

US 2011/0212673 A1 Sep. 1, 2011

Related U.S. Application Data

(63) Continuation of application No. 11/771,765, filed on Jun. 29, 2007, now Pat. No. 7,942,724.

(60) Provisional application No. 60/818,423, filed on Jul. 3, 2006.

(51) Int. Cl.
*B24B 7/22* (2006.01)

(52) U.S. Cl.
USPC ..... 451/6; 451/534

(58) Field of Classification Search
USPC ..... 451/6, 5, 7, 41, 287, 288–290
See application file for complete search history.

(56) References Cited

U.S. PATENT DOCUMENTS

| | | | | |
|---|---|---|---|---|
| 5,893,796 | A | 4/1999 | Birang et al. | |
| 6,045,439 | A * | 4/2000 | Birang et al. | 451/526 |
| 6,068,539 | A * | 5/2000 | Bajaj et al. | 451/6 |
| 6,454,630 | B1 * | 9/2002 | Tolles | 451/6 |
| 6,458,014 | B1 * | 10/2002 | Ihsikawa et al. | 451/6 |
| 6,641,470 | B1 | 11/2003 | Zhao et al. | |
| 6,685,537 | B1 | 2/2004 | Fruitman et al. | |
| 6,832,949 | B2 * | 12/2004 | Konno et al. | 451/285 |
| 6,855,034 | B2 | 2/2005 | Hasegawa | |
| 6,866,559 | B2 * | 3/2005 | Lehman et al. | 451/6 |
| 7,264,536 | B2 | 9/2007 | Wiswesser et al. | |
| 2004/0224611 | A1 | 11/2004 | Aoi et al. | |
| 2005/0090187 | A1 * | 4/2005 | Shih et al. | 451/6 |
| 2006/0128271 | A1 * | 6/2006 | Shiho et al. | 451/6 |

FOREIGN PATENT DOCUMENTS

| | | |
|---|---|---|
| JP | 2001-198802 | 7/2001 |
| JP | 2003-019658 | 1/2003 |
| TW | 200510470 | 3/2005 |

OTHER PUBLICATIONS

Applied Materials, Inc., International Search Report and Written Opinion of the corresponding PCT Application No. PCT/US2007/072690 dated Aug. 22, 2008.

Applied Materials, Inc., International Preliminary Report on Patentability of the corresponding PCT Application No. PCT/US2007/072690 dated Mar. 12, 2009.

Taiwan Office Action dated Oct. 4, 2011 for Application No. 96124191, 2 pages.

Japanese Office Action dated Jun. 19, 2012 for Application No. 2009-518606, 5 pages.

* cited by examiner

*Primary Examiner* — Robert Rose
(74) *Attorney, Agent, or Firm* — Fish & Richardson P.C.

(57) ABSTRACT

A polishing pad has an opaque polishing layer with an aperture therethrough and a polishing surface, and a solid light-transmissive window in the aperture. The solid light-transmissive window includes an outer portion secured to the polishing layer and an inner portion secured to the outer portion. The outer portion has a upper surface recessed relative to the polishing surface, whereas the inner portion has an upper surface that is substantially co-planar with the polishing surface.

17 Claims, 3 Drawing Sheets

POLISHING PAD WITH PARTIALLY RECESSED WINDOW

CROSS-REFERENCE TO RELATED APPLICATIONS

This application is a continuation of U.S. application Ser. No. 11/771,765, filed Jun. 29, 2007, which claims priority to U.S. application Ser. No. 60/818,423, filed on Jul. 3, 2006, each of which is incorporated by reference.

BACKGROUND

This invention relates a polishing pad for use in chemical mechanical polishing (CMP).

In the process of fabricating modern semiconductor integrated circuits (IC), it is often necessary planarize the outer surface of the substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, the invention is directed to a polishing pad. The polishing pad has an opaque polishing layer with an aperture therethrough and a polishing surface, and a solid light-transmissive window in the aperture. The solid light-transmissive window includes an outer portion secured to the polishing layer and an inner portion secured to the outer portion. The outer portion has a upper surface recessed relative to the polishing surface, whereas the inner portion has an upper surface that is substantially co-planar with the polishing surface.

Implementations of the inventions may include one or more of the following features. The outer portion can surround the inner portion. The outer portion can be rectangular and the inner portion can be square. The inner portion and the polishing layer can have substantially the same hardness. The outer portion can be harder than the inner portion. The outer portion can have substantially the same hardness as the polishing layer. Corners of the inner portion that project above the upper surface of the outer portion can be smoothed, e.g., beveled or rounded. Corners of an inner edge of the polishing layer that project above the upper surface of the outer portion can be smoothed. The inner portion can be molded to the outer portion. Bottom surfaces of the polishing layer, the first portion and the second portion can be substantially coplanar.

In another implementation, the invention is directed to a method of fabrication a polishing pad. The method includes forming a first light-transmissive layer in an aperture in an opaque polishing layer, and forming a second light-transmissive layer in an aperture in the first light-transmissive layer. The first light-transmissive layer has an upper surface recessed relative to a polishing surface of the polishing layer, and the second light-transmissive layer has an upper surface that is substantially co-planar with the polishing surface.

Implementations of the inventions may include one or more of the following features. Forming the second light-transmissive layer in the aperture in the first light-transmissive layer can include cutting a hole in the first light-transmissive layer. Forming the second light-transmissive layer in an aperture in the first light-transmissive layer can include filling a hole in the first light-transmissive layer with a liquid precursor and curing the precursor. Curing the precursor can create a transparent body that projects above the polishing surface. The body can be ground until an upper surface of the second portion is substantially co-planar with the polishing surface. Filling the hole with the liquid precursor can create a meniscus that projects above the polishing surface. Corners of the second portion that project above the upper surface of the first portion can be smoothed.

Potential advantages of the invention may include one or more of the following. The window is relative soft (e.g., as compared to a conventional window for an IC1000 type polishing pad. Thus, the window can be used with a softer polishing pad, e.g., a Politex polishing pad, with low danger of scratching the substrate.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
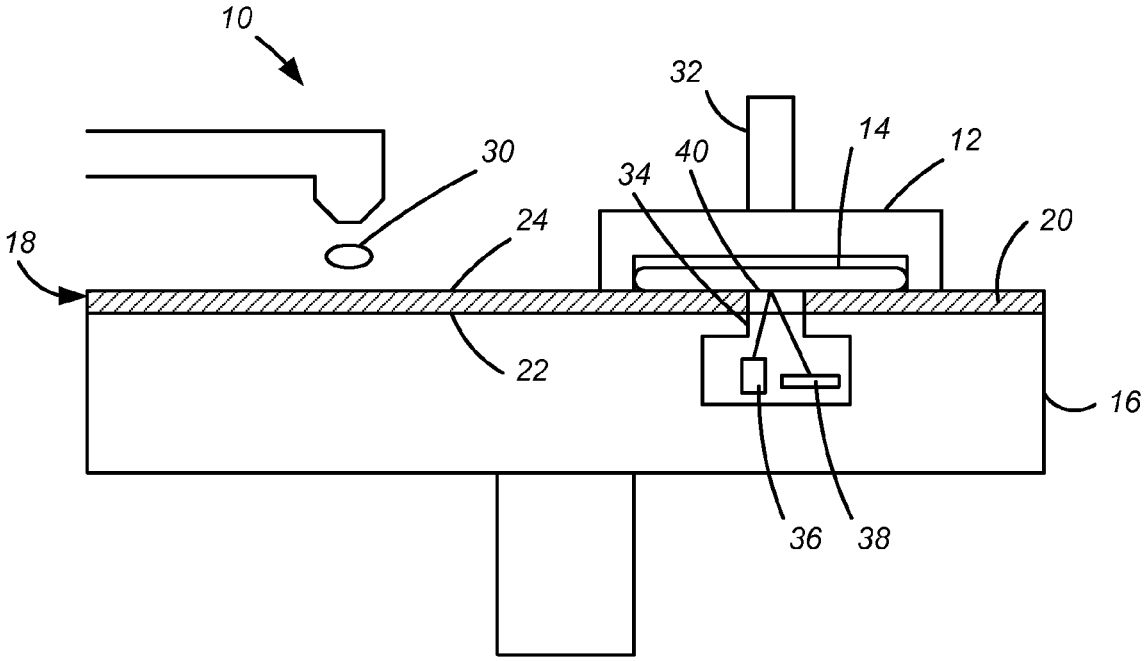
FIG. 1 is a schematic across-sectional side view of a chemical mechanical polishing apparatus with an optical monitoring system for endpoint detection.

As shown in FIG. 1, the CMP apparatus 10 includes a polishing head 12 for holding a semiconductor substrate 14 against a polishing pad 18 on a platen 16. The CMP apparatus may be constructed as described in U.S. Pat. No. 5,738,574, the entire disclosure of which is incorporated herein by reference.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The effective portion of the polishing pad 18 can include a polishing layer 20 with a bottom surface 22 to secured to the platen 16 and a polishing surface 24 to contact the substrate. The polishing layer can be a relatively soft material suitable for a buffing process. Such polishing pads can have a hardness in the Shore A range, e.g., 50 to 80 Shore A. In one implementation, the polishing pad includes a poromeric coating with large vertically oriented pores disposed over a microporous felt substrate. Such a polishing pad is available under the trade name Politex from Rohm & Hass. An example of soft polishing pad is described in U.S. Pat. No. 4,841,680. In some implementations, grooves can be formed in the polishing surface 24.

Typically the polishing pad material is wetted with a chemical polishing liquid solution 30 with abrasive particles. The liquid can be a solution including a chemically reactive components. For example, the slurry can include KOH (potassium hydroxide) and fumed-silica particles. However, some polishing processes are "abrasive-free".

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. The pressure and relative motion between the substrate and the polishing surface, in conjuction with the polishing solution, result in polishing of the substrate.

An optical aperture 34 is formed in the top surface of the platen 16. An optical monitoring system, including a light source 36, such as a laser, and a detector 38, such as a photodetector, can be located below the top surface of the platen 16. For example, the optical monitoring system can be located in a chamber inside the platen 16 that is in optical communication with the optical aperture 34, and can rotate with the platen. The optical aperture 34 can be filled with a transparent solid piece, such as a quartz block, or it can be an empty hole. In one implementation, the optical monitoring system and optical aperture are be formed as part of a module that fits into a corresponding recess in the platen. Alternatively, the optical monitoring system could be a stationary system located below the platen, and the optical aperture could extend through the platen. The light source can employ a wavelength anywhere from the far infrared to ultraviolet, such as red light, although a broadband spectrum, e.g., white light, can also be used, and the detector can be a spectrometer.

A window 40 is formed in the overlying polishing pad 18 and aligned with the optical aperture 34 in the platen. The window 40 and aperture 34 can be positioned such that they have a view of the substrate 14 held by the polishing head 12 during at least a portion of the platen's rotation, regardless of the translational position of the head 12.

The light source 36 projects a light beam through the aperture 34 and the window 40 to impinge the surface of the overlying substrate 14 at least during a time when the window 40 is adjacent the substrate 14. Light reflected from the substrate forms a resultant beam that is detected by the detector 38. The light source and the detector are coupled to an unillustrated computer that receives the measured light intensity from the detector and uses it to determine the polishing endpoint, e.g., by detecting a sudden change in the reflectivity of the substrate that indicates the exposure of a new layer, by calculating the thickness removed from of the outer layer (such as a transparent oxide layer) using interferometric principles, or by monitoring the signal for predetermined endpoint criteria.

Figure 2:
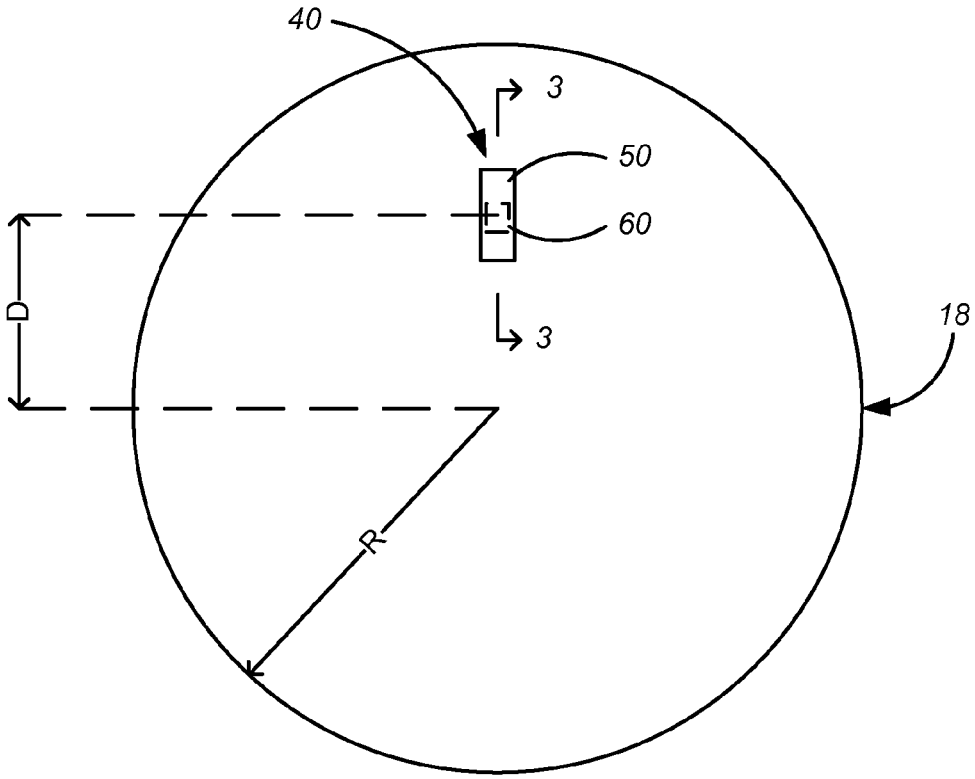
FIG. 2 is a simplified top view of a polishing pad with a window.

Referring to FIG. 2, in one implementation the polishing pad 18 has a radius R of 15.0 inches (381.00 mm), with a corresponding diameter of 30 inches. In other implementations, the polishing pad 18 can have a radius of 15.25 inches (387.35 mm) or 15.5 inches (393.70 mm), with corresponding diameter of 30.5 inches or 31 inches. The optical monitoring system can use an area about 0.5 inches (12.70 mm) wide and 0.75 inches (19.05 mm) long centered a distance D of 7.5 inches (190.50 mm) from the center of the polishing pad 18. Thus, the window should cover at least this area.

Figure 3:
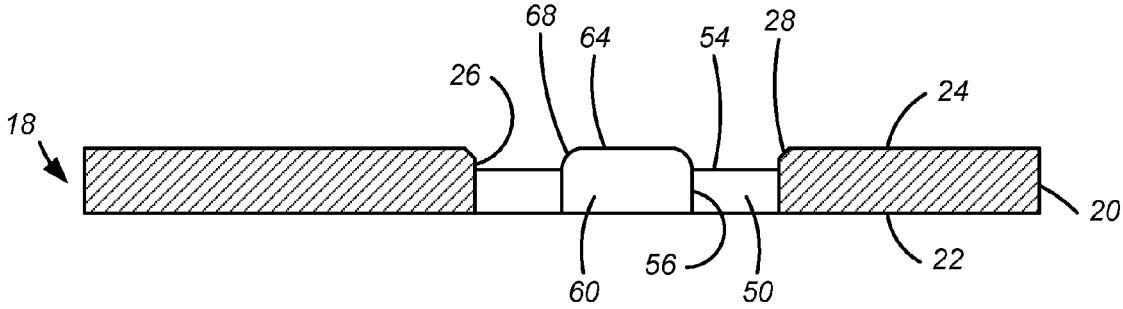
FIG. 3 is a simplified schematic cross-sectional view of the polishing pad of FIG. 2 along line 3-3.

Referring to FIG. 2-3, the window 40 can include two portions, a thin outer portion 50 and a thicker central portion 60. Both portions of the window can formed from a polymer material, e.g. polyurethane.

The thin outer portion 50 can have a top surface 54 that is recessed relative the uncompressed polishing surface 24. The outer portion 50 can be secured to the inner edges 26 of the polishing layer 20. Alternatively, if the polishing pad 18 includes a backing layer, e.g., a compressible subpad or an incompressible backing film, then the outer portion can be secured to the backing layer. In addition, the outer portion 50 of the window 40 can be formed of a material that is harder than the polishing layer 20, e.g., a relatively pure polyurethane without fillers, e.g., JR111 or Calthan 3200. The polishing layer 20 itself does not extend over the outer portion 50 of the window 40, so that the top surface 54 is exposed to the polishing environment and can transmit light.

The outer portion 50 of the window 40 can have a rectangular shape with its longer dimension substantially parallel to the radius of the polishing pad that passes through the center of the window. However, the outer portion 50 can have other shapes, such as circular or oval, and the center of the window need not be located at the center of the area used by the optical monitoring system. The outer portion 62 can have a length of about 2.25 (57.15 mm) inches and a width of about 0.75 inches (19.05 mm).

The thick central portion 60 of the window 40 can have a top surface 64 that is substantially coplanar with the polishing surface 24. The bottom surface of the central portion 60 can be coplanar with both the bottom surface of the thin portion 50 and the polishing layer 20. The central portion 60 can be secured to the inner edges 56 of the outer portion 50, e.g., by being cured in place in an aperture in the outer portion and thus molded to the outer portion. The outer portion 50 can completely surround the central portion 60.

The thick central portion 60 can be formed of the same material as the thin outer portion 50, e.g., a relatively pure polyurethane without fillers, but with about the same hardness as the polishing layer 20 (the thick portion can be formed using a different ratio of precursors, e.g., polyol and diisocyanate, than the thin portion in order to achieve the different hardness). Thus, the thick portion 60 is softer than the thin portion 50. Because the central portion 60 has about the same hardness as the polishing layer 20, the likelihood of scratching the substrate can be reduced, thus increasing yield.

The central portion 60 of the window 40 can be square and be positioned in the center of the outer portion 50. However, the central portion 60 can have other shapes, such as circular. A circular central portion may be less likely to scratch the substrate. The central portion can be about 0.5 inches across, e.g., a 0.5 by 0.5 inch square.

In one implementation of the polishing pad, the outer portion 50 is rectangular whereas the central portion 60 is square. In another implementation, the outer portion 50 rectangular whereas the central portion 60 is circular. In another implementation, the outer portion 50 and the central portion 60 are generally congruent shapes, e.g., both rectangular or both circular.

The corners 68 of the thick central portion 60 that project above the thin outer portion 50 can be smoothed, e.g., rounded or beveled, to further reduce the likelihood of scratching the substrate. The inner corners 28 of the polishing layer 20 can also be smoothed, e.g., rounded or beveled.

Figure 4:
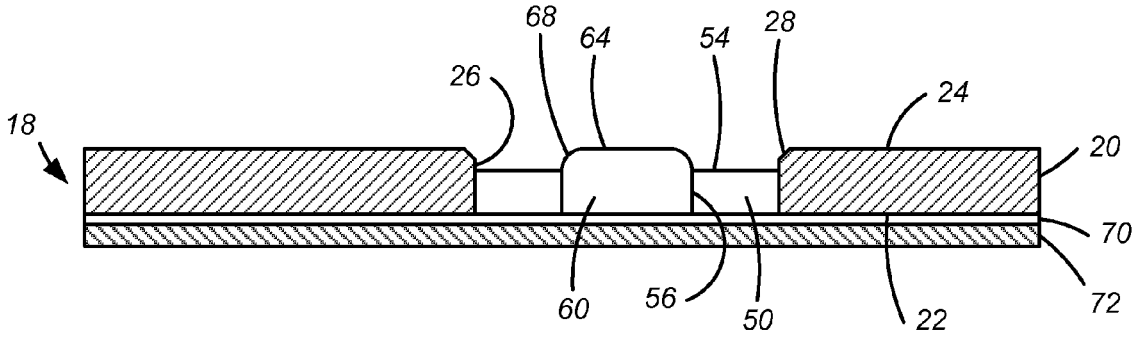
FIG. 4 is a simplified schematic cross-sectional view of a polishing pad with a pressure sensitive adhesive and liner.

Referring to FIG. 4, before installation on a platen, the polishing pad 18 can also include a pressure sensitive adhesive 70 and a liner 72 that spans the bottom surface 22 of the polishing pad. In use, the liner is peeled from the polishing layer 20, and the polishing layer 20 is applied to the platen with the pressure sensitive adhesive 70. The pressure sensitive adhesive 70 and liner 72 can span the window 40, or either or both can be removed in and immediately around the region of the window 40.

Figure 5:
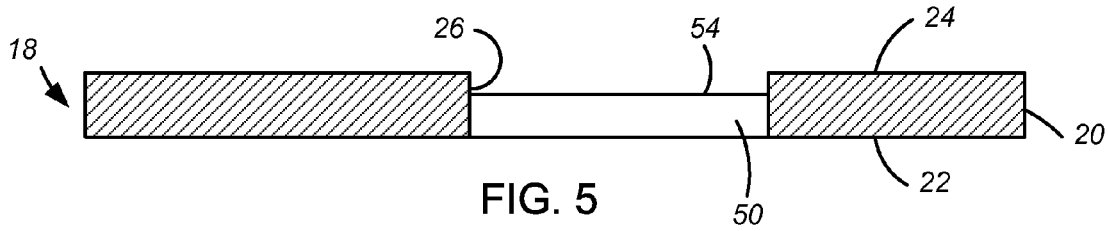
FIGS. 5-8 are cross-sectional views illustrating assembly of a polishing pad.
Figure 6:
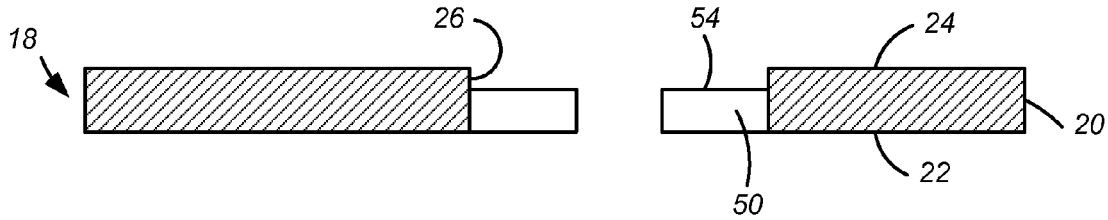
Figure 7:
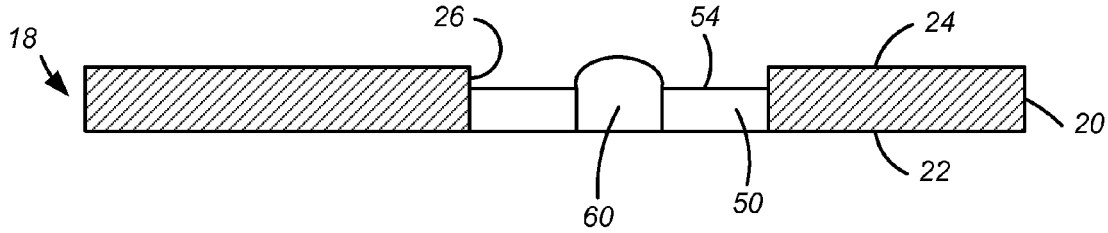
Figure 8:
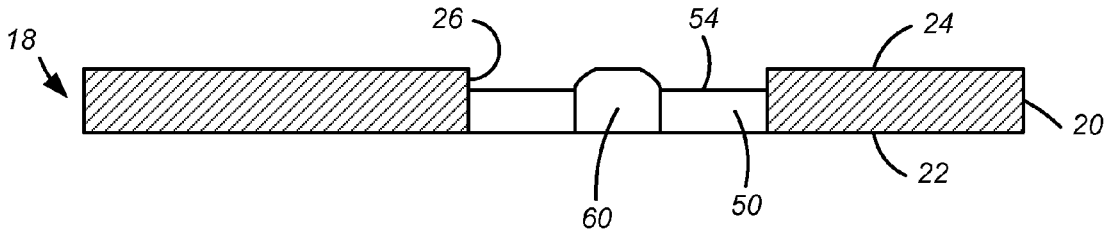

To manufacture the polishing pad, initially a thin window layer (which will become thin portion 50) can be installed in the polishing layer 20, as shown by FIG. 5. Then, the region in which the thick central portion will be formed is removed from window layer, as shown by FIG. 6. One or more liquid polyurethane precursors are poured into the hole. Surface tension of the precursor liquid is such that a meniscus is formed so that the liquid protrudes above the polishing surface 24, as shown by FIG. 7. Then the liquid polyurethane is cured to form a solid plastic, and the solid plastic is flattened, e.g., by abrasion with a diamond conditioning disk, to form the thick central portion of the window, as shown by FIG. 8. The corners of the thick central portion and the polishing layer can then be smoothed, if necessary.

In another implementation, both the thin outer portion and the thick inner portion of the window are formed of a soft material and have substantially the same hardness. Thus, both the thin outer portion and the thick inner portion have about the same hardness as the polishing layer 20.

In general, polishing pads used for buffing, e.g., Politex, are softer than polishing pads used for polishing, e.g., cast polyurethane with fillers, such as IC-1000 material from Rohm & Hass. Thus, in a multi-station polishing system in which the substrate is polishing in sequence by different polishing pads at the different stations, the polishing pad 18 can be the last polishing pad in the sequence and can be the softest polishing in the sequence.

A number of embodiments of the invention have been described. Nevertheless, it will be understood that various modifications may be made without departing from the spirit and scope of the invention. For example, the invention may be applicable to polishing pads made of other materials, e.g., a polyester fiber felt, or to multilayer polishing pads. Accordingly, other embodiments are within the scope of the following claims.

What is claimed is:

1. A polishing pad, comprising:

an opaque polishing layer having an aperture therethrough and having a polishing surface; and a solid light-transmissive window in the aperture, the solid light-transmissive window including a single outer portion directly contacting and secured to a sidewall of the aperture through the polishing layer, the outer portion having a flat upper surface, the flat upper surface parallel to and recessed relative to the polishing surface, wherein the upper surface where the outer portion contacts the sidewall is not covered by the polishing layer, and a single inner portion secured to the outer portion, the inner portion having an upper surface that is substantially co-planar with the polishing surface, wherein the outer portion completely surrounds the inner portion.

2. The polishing pad of claim 1, wherein a bottom surface of the polishing layer and lower surfaces of the inner portion and the outer portion of the window are substantially coplanar.

3. The polishing pad of claim 2, further comprising a liner adhered to the bottom surface of the polishing layer and spanning the bottom surface of the polishing layer and the lower surfaces of the inner portion and the outer portion of the window.

4. The polishing pad of claim 1, wherein the inner portion laterally spans an entire area between inner edges of the outer portion.

5. The polishing pad of claim 4, wherein the outer portion laterally spans an entire area between an outer edge of the inner portion and an inner edge of the polishing layer.

6. The polishing pad of claim 1, wherein the outer portion laterally spans an entire area between an outer edge of the inner portion and an inner edge of the polishing layer.

7. The polishing pad of claim 1, wherein the window consists of the outer portion and the inner portion.

8. The polishing pad of claim 1, wherein the outer portion includes an outermost edge, and the outermost edge directly contacts and is secured to the sidewall of the aperture.

9. The polishing pad of claim 1, wherein the outer portion is rectangular and the inner portion is square.

10. The polishing pad of claim 1, wherein the inner portion and the polishing layer have substantially the same hardness.

11. The polishing pad of claim 1, wherein the outer portion has substantially the same hardness as the polishing layer.

12. The polishing pad of claim 1, wherein corners of the inner portion that project above the upper surface of the outer portion are smoothed.

13. The polishing pad of claim 12, wherein the corners are beveled or rounded.

14. The polishing pad of claim 1, wherein corners of an inner edge of the polishing layer that project above the upper surface of the outer portion are smoothed.

15. The polishing pad of claim 1, wherein the inner portion is molded to the outer portion.

16. The polishing pad of claim 1, wherein the polishing layer comprises a poromeric coating disposed over a microporous felt substrate.

17. The polishing pad of claim 1, wherein none of the upper surface of the outer portion is covered by the polishing layer.

* * * * *